United States Patent [19]

Hall

[11] 4,213,215

[45] Jul. 22, 1980

[54] CONTAINER OPENER

[76] Inventor: A. Douglass Hall, David's Hill Rd., Bedford Hills, N.Y. 10507

[21] Appl. No.: 891,051

[22] Filed: Mar. 28, 1978

[51] Int. Cl.[2] ..... B67B 7/00

[52] U.S. Cl. ..... 7/152; 81/3.47; D8/38

[58] Field of Search ..... 7/151, 152; 30/443, 30/450; 81/3.46 R, 3.46 A, 3.47, 3.48; D8/38

[56] References Cited

U.S. PATENT DOCUMENTS

| | | | |
|---|---|---|---|
| D. 240,999 | 8/1976 | Hall | D8/38 |
| 2,646,705 | 7/1953 | Belpedio | 81/3.46 A |
| 2,697,275 | 12/1954 | Moyle | 7/152 X |
| 2,737,069 | 3/1956 | Weindel, Jr. | 7/152 X |
| 2,851,704 | 9/1958 | Zoeller | 7/152 |

*Primary Examiner*—James G. Smith

*Attorney, Agent, or Firm*—Pennie & Edmonds

[57] ABSTRACT

An improved container opener is disclosed for removing bottle caps of the threaded type. The container opener has a handle and a bottle and/or can opener at one end of the handle. The bottle opener includes a lip for engaging the top of a standard bottle cap and a tang for engaging under the skirt of the bottle cap for prying the cap from a bottle. The can opener includes a tapered blade terminating in a point for piercing the top of a can and a tang for engaging the side of the can while the blade is piercing the top. The improvement comprises means disposed on at least one of the bottle opener and the can opener for engaging a threaded bottle cap in at least three spaced locations defining a triangle such that counterclockwise rotation of the container opener as it engages the threaded bottle cap will rotatably remove the cap.

4 Claims, 8 Drawing Figures

FIG. 4.
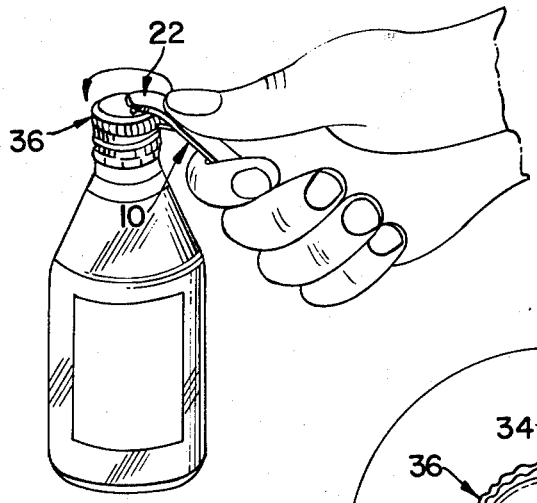
FIG. 3.
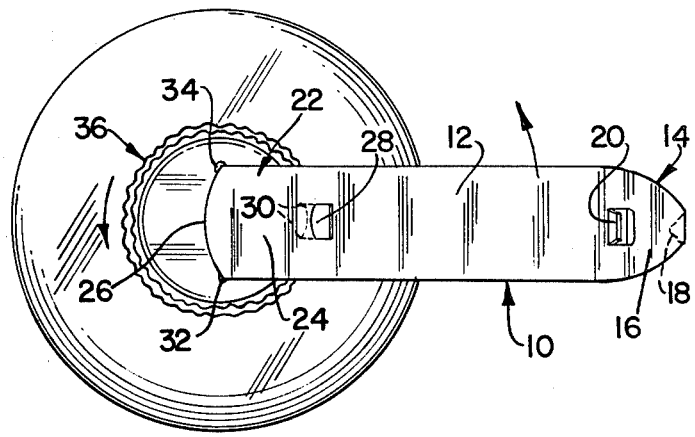
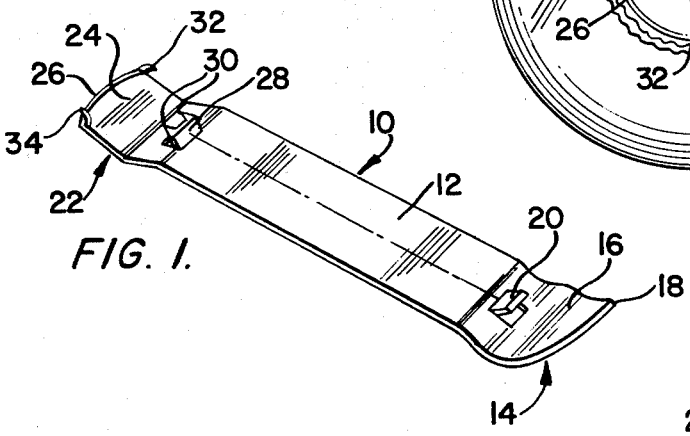
FIG. 1.
FIG. 5.
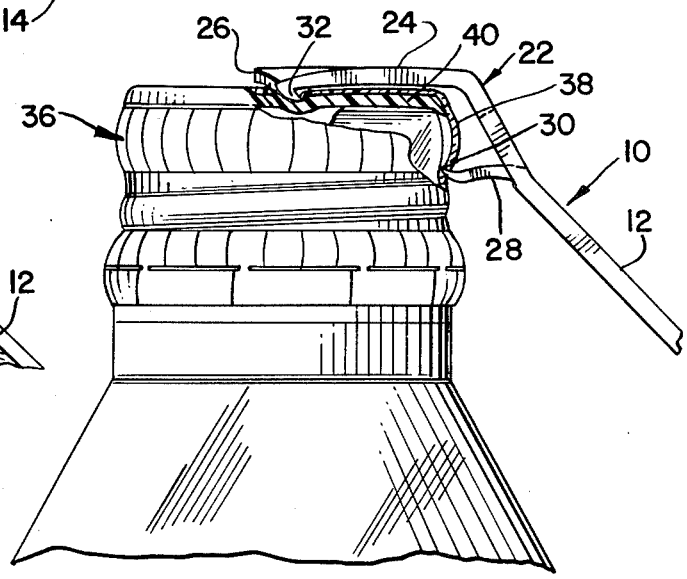
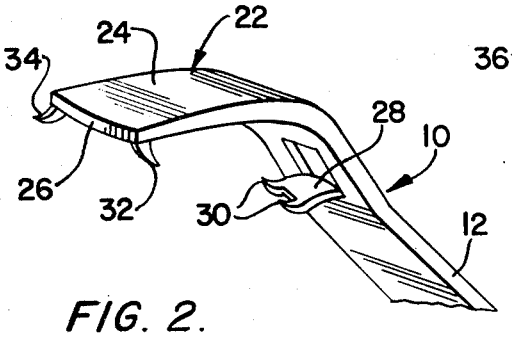
FIG. 2.

CONTAINER OPENER

BACKGROUND OF THE INVENTION

1. Field of the Invention

This invention relates to improvements in a container opener having a bottle and/or can opener at one end of a handle to provide the container opener with the additional capability of removing threaded bottle caps.

2. Description of the Prior Art

Several types of container openers for removing standard bottle caps and opening cans by either piercing or cutting away the top of the can are well known in the art. It is common for such tools to have multiple functions by combining bottle opener, can opener, cork screw, etc. on a single implement. Typical of these combination tools is the common, household bottle and can opener formed from a flat strip of metal wherein a portion of the metal strip serves as a handle whose ends are shaped into a bottle opener and a can opener.

There are also known implements for removing bottle caps of the screw or threaded type. For example, U.S. Pat. No. 2,695,536 to Voytech relates to screw-cap openers for bottles, jars and the like. The Voytech implement comprises a single elongated piece of metal, having a handle portion at one end, a pair of bent-over tabs at its other end for engaging the periphery of the screw-cap, and a needle disposed between the tabs for piercing the top of the cap to relieve the fluid pressure inside the container.

Another example of an implement for opening bottle caps of the screw type is U.S. Pat. No. 2,735,318 to Hrebicek. Hrebicek discloses an implement similar to the Voytech design in that they both include an elongated strip of metal which also serves as a handle and a pair of tabs and a needle projecting generally perpendicularly from periphery of the strip metal. In the Hrebicek design the relative shape, size and location of the needle and the pair of tabs have been altered for improved operation, in particular to allow the threaded cap to be removed with reduced effort than previously required. The Voytech and Hrebicek implements lack the complementary functions which the first mentioned devices are capable, being able to remove standard bottle caps and opening cans.

I have discovered that standard bottle and/or can openers may be modified to remove a threaded bottle cap while retaining its traditional function of either removing a bottle cap by prying it from a bottle or opening the top of a can. The additional feature is particularly useful when a threaded bottle cap which is designed for relatively easy manual removal becomes stuck so that it can be removed only with great effort. Moreover, the present invention alleviates the necessity for procuring a separate instrument to serve the single function of removing uncooperative threaded bottle caps.

SUMMARY OF THE INVENTION

The invention relates to an improved container opener having a bottle and/or can opener at one end of a handle. The bottle opener includes a lip for engaging the top of a bottle cap and tang means for engaging under the skirt of the cap for prying the cap from a bottle. The can opener includes a blade terminating in a point for piercing the top of a can and tang means for engaging side of the can. The improvement comprises means on at least one of the bottle opener and the can opener for engaging a threaded bottle cap in at least three spaced locations defining a triangle whereby the threaded bottle cap may rotatably be removed.

In one embodiment of the invention the engaging means are provided on the bottle opener end of the container opener. In this embodiment the engaging means comprises two pairs of pointed teeth. One pair is disposed at spaced locations on the free end of the tang of the bottle opener in triangular relationship with the other pair which is disposed at spaced locations on the free end of the lip of the bottle opener.

Preferably, the tang means straddles the longitudinal axis of the handle and the pair of teeth extending from the foreward edge of the lip are disposed at opposed lateral sides of the longitudinal axis of the handle. The pair of teeth projecting from the tang means may also be disposed at opposed sides of the longitudinal axis of the handle so that the four teeth define the corners of a trapezoid whose non-parallel sides are equilateral.

Preferably, a first tooth projecting from the lip of the bottle opener is curved rearwardly and towards the tang means of the bottle opener and a second tooth projecting from the lip is curved forwardly and away from the tang means of the bottle opener such that upon counterclockwise rotation of the opener as it engages the threaded bottle cap the two teeth point in the direction of rotation to facilitate removal of the cap.

In another embodiment of the invention the engaging means is on the can opener end of a container opener. In this embodiment the engaging means comprises the point of the tapered blade of the can opener for engaging the top of a threaded bottle cap and two pointed tips projecting from either side of the rearward portion of the blade toward the point of the blade for engaging the skirt of the threaded bottle cap. The point of the blade together with the two pointed tips define the corners of a triangle, which is preferably acute. These three points permit engagement of a threaded bottle cap at its top and skirt or side portions, respectively. The location of engagement at the top of the bottle cap is preferably at or about its center point.

Either of these embodiments may also be provided with gripping means between the ends of which the tool may be rotatably secured so that one end of the implement is at least partially enclosed when the longitudinal axis of the gripping means is aligned with the longitudinal axis of the handle of the container opener.

BRIEF DESCRIPTION OF THE DRAWINGS

Preferred embodiments of the present invention are described below and illustrated in the drawings, wherein:

FIG. 1 is a perspective plan view of the bottom of an embodiment of the present invention;

FIG. 2 is a fragmentary enlarged view of the embodiment of FIG. 1.

FIG. 3 is a top view of the embodiment of FIG. 1 illustrating engagement of a threaded bottle cap by the present invention.

FIG. 4 is a perspective view of the embodiment of FIG. 1 showing it grasped by an operator as it is applied to a threaded bottle cap;

FIG. 5 is a fragmentary enlarged side view of the present invention illustrating engagement of a threaded bottle cap which is shown partially sectioned;

DETAILED DESCRIPTION OF THE PREFERRED EMBODIMENTS

Figure 8:
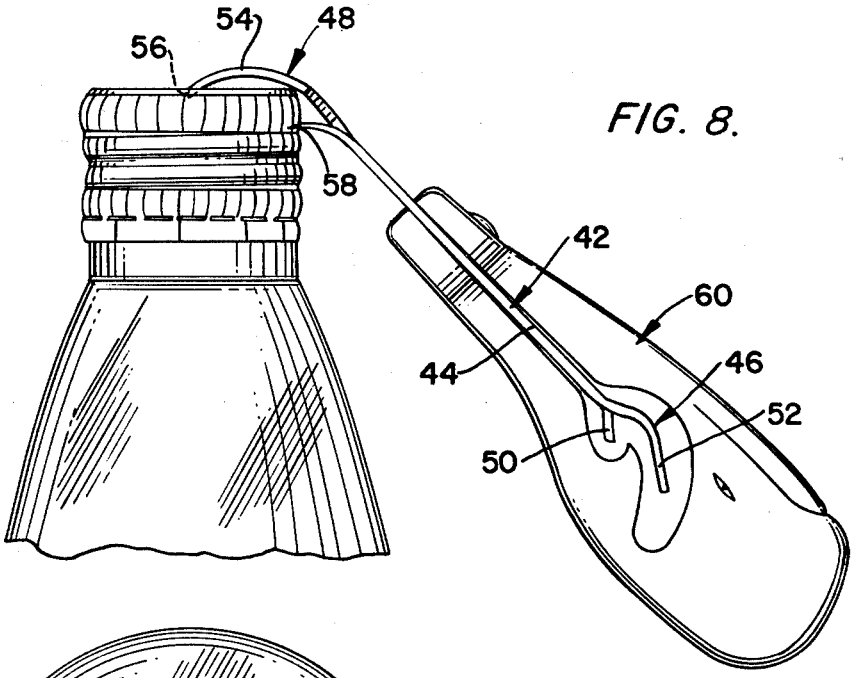
FIG. 8 is a side view illustrating engagement of a threaded bottle cap by the embodiment of FIG. 6.

FIG. 1 illustrates a combination bottle and can opener 10 which typically may be molded, cast or stamped into an elongated strip of sheet metal; however, any suitable material may be used. In the container opener 10 a typical flat and elongated handle 12 is illustrated, although the handle may be any shape convenient for grasping such as, for example, a rectangular solid or a cylinder. The handle, may for example, be made out of metal or plastic; however, it is not necessary that the handle be made out of the same material as either the bottle opener or the can opener.

At one end of the handle there is a can opener 14 which includes a blade 16 extending from the handle terminating in a point 18 for piercing the top of a can in the usual fashion. The blade is arcuate and tapered. The can opener also includes a tang 20 for engaging the side of the can extending from the same end of the handle as does the blade. The tang 20 projects toward the point 18 of the blade 16. The tang 20 is narrower than and straddles the lateral axis of the handle. As illustrated, the tang may be cut and shaped from the strip of sheet metal. The tang and the blade cooperate for piercing cans in typical fashion well known in the art.

At the other end of the handle 12 and extending therefrom there is a bottle opener 22. It should be understood that both the bottle opener and the can opener may extend from the same end of the handle (not shown). The bottle opener includes a lip 24 for engaging the top of a bottle cap. The lip 24 may have parallel sides of the same width as the handle and a rounded free end 26. The bottle opener also includes a tang 28 similar in shape to the tang 20 of the can opener 14, which likewise straddles the lateral axis of the handle 12 and projects from one end portion thereof for engaging under the skirt of the bottle cap for cooperation with the lip 24 to pry open a standard bottle cap (not shown).

The bottle opener 22 is provided with means such as teeth 30, 32 and 34 disposed on the tang 28 and lip 24 for engaging a threaded bottle cap to rotatably remove it from a bottle. The engaging means on the bottle cap portion of the combination tool are shown in greater detail in FIG. 2.

FIG. 2 illustrates the engaging means which comprises a pair of spaced-apart pointed teeth 30 projecting from the sides of the free end of the tang 28 and a pair of pointed teeth 32 and 34 projecting from the free end 26 of the lip 24. As illustrated in FIGS. 1 and 2, a first pointed tooth 32 is curved rearwardly and projects toward the tang 28 and a second pointed tooth 34 is curved forwardly and projects away from the tang 28 such that upon counterclockwise rotation of the opener, as it is engaged with the threaded bottle cap, as illustrated in FIGS. 3 and 4, the teeth 32 and 34 point in the direction of rotation to facilitate removal of the cap. The pair of teeth 32 and 34 are in triangular relationship with the teeth 30 whereas the teeth 32 and 34 together with the pair of teeth 30 define the four corners of a trapezoid whose non-parallel sides are equilateral.

FIG. 5 illustrates the bottle opener engaged with the threaded bottle cap 36. The bottle cap 36 has an outer metallic layer 38 and an inner protective flexible liner 40 for retaining carbonation and/or pressure of the contents of the bottle even if the outer layer 38 is pierced. The fragmentary portion of FIG. 5 illustrates the bottle opener 22 engaging the bottle cap 36 without puncturing the inner protective flexible liner 40. This feature of the inventive device permits reuse of the threaded bottle cap without excessive loss of carbonation of the remaining portion of the contents.

Figure 6:
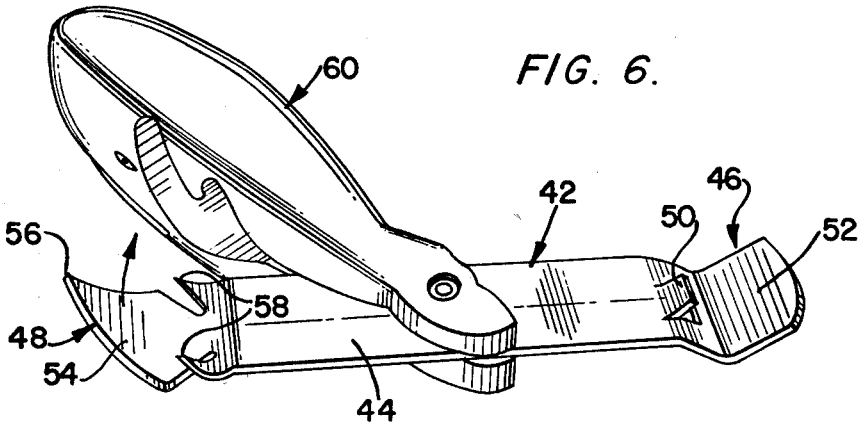
FIG. 6 is a perspective view of another embodiment of this invention.

FIG. 6 illustrates another embodiment of the invention. This embodiment also depicts a container opener 42 having a handle 44, a bottle opener 46 at one end thereof and a can opener 48 at the other end. The bottle opener portion of this embodiment also includes a tang 50 and a lip 52 as does the bottle opener 22 of the embodiment illustrated in FIG. 1, but is different from the bottle opener of FIG. 1 in that there are no engaging means provided thereon. The tang 50 and lip 52 of this bottle opener cooperate to pry open a standard bottle cap in a fashion well known in the art.

The engaging means for removing a threaded bottle cap by means of this embodiment ar provided on the can opener 48 end of this tool 42. The can opener 48 includes an arcuate tapered blade 54 extending from the handle 44 and terminating in a point 56 for engaging the top of a can or a threaded bottle cap. The can opener 48 also includes tang means which comprises a pair of pointed teeth 58 for engaging the side of the can or the skirt of the threaded bottle cap. The teeth 58 extend from rearward portions of the blade 54, are disposed on opposed lateral sides of the longitudinal axis of the handle 44, and point in the same general direction as does the point 56 of the blade 54. As illustrated in FIG. 6, the pointed teeth 58 may be cut and bent inward from the rearward portions of the sides of the blade 54. The point 56 of the blade 54 and the two pointed teeth 58 define the corners of a triangle which is preferably acute.

Figure 7:
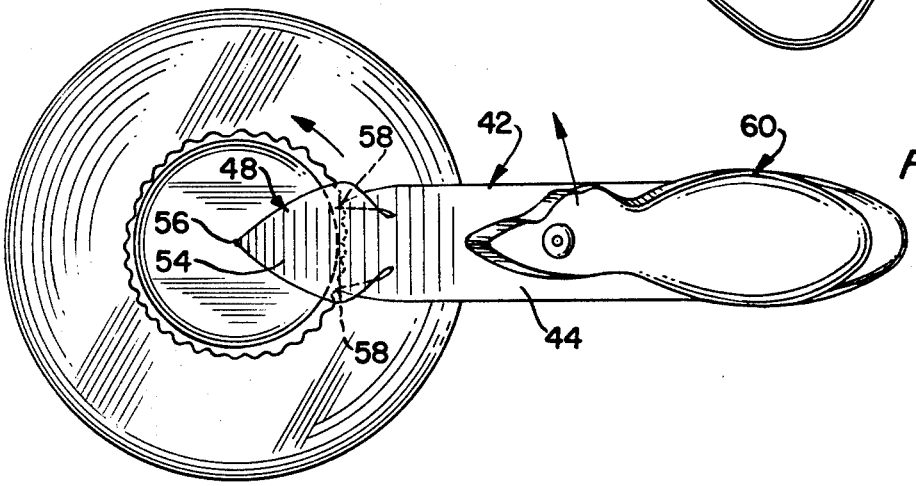
FIG. 7 is a top view of the embodiment of FIG. 6.

As illustrated in FIG. 7, when the point 56 of the blade 54 and the pointed teeth 58 engage the threaded bottle cap in three locations, including the top and two spaced locations on the skirt of the bottle cap, respectively, counterclockwise rotation of the combination tool provides removal of the threaded bottle cap.

In this embodiment, it is additionally adantageous to locate the point 56 of the blade 54 near the center of the bottle cap for added stability during the rotational removal thereof. Since most containers having threaded bottle caps have a standard size opening, the blade 54 can be designed with the particular dimensions that will enable this feature to be generally achieved.

The embodiment illustrated in FIGS. 6–8 may also be provided with a housing 60. In the illustrated example, the container opener 42 is rotatably mounted at its handle 44 to permit utilization of either the bottle opener or the can opener. The interior of the housing has a portion cut away to permit rotation of the container opener so that one end of the handle may be partially enclosed, as illustrated in FIGS. 7 and 8, when the other end is utilized.

The particular housing illustrated in FIGS. 6–8 depicts the ornamental design for a combined bottle and can opener which is the subject of my U.S. Pat. No. De. 240,999. A housing of this type may, of course, also be provided with other embodiments such as, for example, the one illustrated in FIG. 1.

I claim:

1. In a container opener having at least a bottle opener at one end of a handle including a lip for engaging the top of a bottle cap and a tang for engaging under the skirt of the cap for prying the cap from a bottle, wherein the improvement comprises:

means for piercing the skirt of a threaded bottle cap projecting from the tang; and a first pair of curved spaced apart teeth projecting from the free end of the lip each terminating in a point for engaging the top of the threaded bottle cap at two locations, wherein the curve of the first of said pair of teeth projecting from the lip is directed toward the tang and the curve of the second of said pair of teeth is directed away from the tang so that when the tang piercing means engages the skirt of the threaded bottle cap and each of the pair of teeth of the lip are in piercing engagement with the top of the threaded bottle cap counterclockwise rotation of the opener will rotatably facilitate removal of the threaded bottle cap.

2. The container opener according to claim 1 wherein said first pair of teeth project from the lip for non-puncturing piercing engagement with the top of the threaded bottle cap.

3. The container opener according to claim 1 wherein said means for piercing the skirt of the threaded bottle cap comprises:

a pair of spaced apart pointed teeth.

4. In a container opener having at least a can opener at one end of a handle, the can opener including a tapered blade terminating in a generally downwardly directed point for piercing the top of a can, wherein the improvement comprises:

at least a pair of spaced apart pointed tips projecting from either side of the rearward portion of the blade each projecting in the same generally downward direction as the point of the tapered blade for engaging the skirt of a threaded bottle cap at two spaced locations such that with the point of the tapered blade engaging the top of the threaded bottle cap and the tips engaging the skirt of the threaded bottle cap counterclockwise rotation of the container opener will rotatably facilitate removal of the threaded bottle cap.

* * * * *